United States Patent [19]

Kataoka

[11] Patent Number: 4,625,151

[45] Date of Patent: Nov. 25, 1986

[54] FLASH DEVICE WITH BACK-UP CAPACITOR VOLTAGE SUPPLY

[75] Inventor: Hiroyuki Kataoka, Tokyo, Japan

[73] Assignee: Canon Kabushiki Kaisha, Tokyo, Japan

[21] Appl. No.: 545,746

[22] Filed: Oct. 26, 1983

[30] Foreign Application Priority Data

Oct. 28, 1982 [JP] Japan ..... 57-190594

[51] Int. Cl.[4] ..... H05B 41/32

[52] U.S. Cl. ..... 315/241 P; 315/159; 354/416; 354/145.1

[58] Field of Search ..... 315/241 P, 159, 173; 354/484, 415, 416, 145.1

[56] References Cited

U.S. PATENT DOCUMENTS

| | | | |
|---|---|---|---|
| 3,787,704 | 1/1974 | Dennewitz et al. | 315/159 X |
| 4,301,392 | 11/1981 | Hirata | 315/241 P |
| 4,396,870 | 8/1983 | Ikeda | 315/241 P |
| 4,469,990 | 9/1984 | Maruyama et al. | 315/241 P |

FOREIGN PATENT DOCUMENTS

| | | | |
|---|---|---|---|
| 52-31733 | 3/1977 | Japan | 354/484 |
| 160142 | 4/1979 | Netherlands | 315/159 |

*Primary Examiner*—David K. Moore
*Assistant Examiner*—Vincent DeLuca
*Attorney, Agent, or Firm*—Toren, McGeady, Stanger, Goldberg & Kiel

[57] ABSTRACT

The disclosed flash device is of the kind that incorporates an integrated processing circuit requiring a stable voltage, but one and the same battery supplies both a booster circuit and the processing circuit. The device avoids the drop in voltage to the processing circuit when the booster circuit draws current after a flash by means of a detector circuit that detects the flash or the operation of the booster circuit. A switching circuit responds to the output of the detector circuit and supplies the charge on a back-up capacitor to the integrated processing circuit. Thus, in the event of a flash, the processing circuit which is normally operated by power from the battery is protected from a supply voltage drop by the supply of a voltage from the back-up capacitor.

8 Claims, 3 Drawing Figures

ASA
VC
IC
LED
PT
Ta Tb Tc Td

ASA
VG
IC
LED
PT
Ia Ib Ic Id

FLASH DEVICE WITH BACK-UP CAPACITOR VOLTAGE SUPPLY

BACKGROUND OF THE INVENTION

1. Field of the Invention

This invention relates to a flash device and more particularly to a flash device having a processing circuit such as an aperture control circuit which is composed of an integrated circuit.

2. Description of the Prior Art

Flash devices generally includes some processing circuit or processor that facilitates flash photography by automatically determining either a flash quantity or an aperture value for a flash. Flash devices of this kind are known, for example, from Japanese Patent Application No. SHO 57-19043 (Japanese Patent Application Laid-Open No. SHO 58-118626,corresponding to U.S. patent application Ser. No. 444,214) and U.S. Pat. Nos. 4,047,194; 4,315,679; 4,078,242; and 4,187,019. Integrated circuits are employed for such processing circuits. Therefore, power to the processing circuit must have a highly stable voltage.

A flash action in a flash device causes a drop in the voltage of the power source. This drop is attributable to the operation of a booster circuit which begins charging flash energy in a storage capacitor after each flash. Accordingly, after a flash, the voltage of power supply to the processing circuit tends to become lower than acceptable by the integrated circuit employed as the processor.

Conceivably, this problem may be overcome by supplying power to the processing circuit bia a smoothing capacitor. However, to supply a stable voltage over a long period of time with this method, the smoothing capacitor must have a large capacitance. Such arrangement not only presents another problem with respect to power consumption but also makes it impossible to render the processing circuit inoperative immediately after a power source switch is turned off.

Meanwhile, the aforementioned U.S. patent application Ser. No. 444,214 proposes a device to solve these problems by supplying power to the processing circuit from a capacitor with a back-up electric charge.

SUMMARY OF THE INVENTION

It is an object of the present invention to provide another arrangement of the flash device of the above-stated back-up type having a back-up capacitor, wherein the flash device includes a detection circuit which detects a flashing action performed by the device and switching means which, in response to the output of the detection circuit, forms a power supply line for supplying the electric charge of the above-stated back-up capacitor to the power supply terminal of an integrated circuit employed as a processing circuit (hereinafter will be called the IC circuit); and, after the flash action, power supply to the IC circuit is backed up to ensure that the power supply to the IC circuit is kept above the operable voltage thereof even when the power source voltage drops after flashing.

The above-stated detection circuit is arranged, as will be described later herein as in embodiment examples, to detect a charging action on a flashing energy storing capacitor in the form of a charging current value and to detect flashing from a flash tube by means of a light sensitive element.

The above and other objects and features of the invention will become clear from the following detailed description of embodiments thereof taken in connection with the accompanying drawings.

DETAILED DESCRIPTION OF THE PREFERRED EMBODIMENTS

Figure 1:
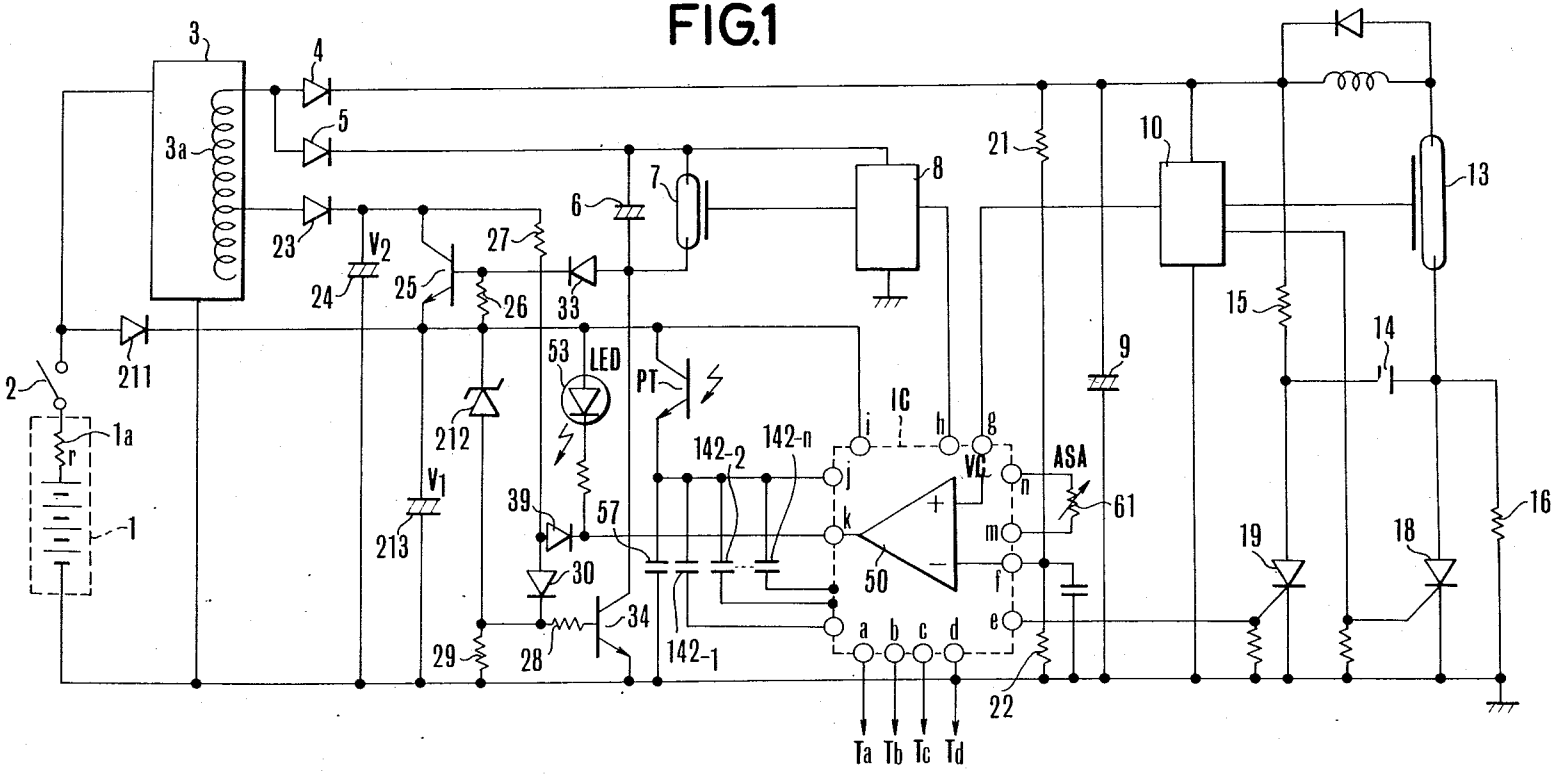
FIG. 1 is a circuit diagram showing a flash device as an embodiment of the present invention.

Referring to FIG. 1 which shows a flash device as an embodiment of the invention, the circuit diagram of FIG. 1 includes a battery 1; an internal resistance r 1*a* of the battery; a main switch 2; a booster circuit 3 such as a DC-to-DC converter or the like; a secondary winding 3*a* for the output of the booster circuit 3; rectifying diodes 4 and 5, the diode 4 being arranged to have a flash energy storing main capacitor 9 charged therethrough; a known trigger circuit 10 which is arranged to trigger a flash discharge tube 13 provided for photographing; a thyristor 18 which is series connected to the discharge tube 13 as semiconductor switching means and is arranged to be turned on by a trigger signal produced from the trigger circuit 10; resistors 15 and 16; a commutation capacitor 14; and a thyristor 19 which is employed as semiconductor switching means. These resistors, commutation capacitor and thyristor constitute a known commutation circuit. The commutation circuit, the trigger circuit and the flash discharge tube constitute a known flash light emitting circuit. The diagram of FIG. 1 further includes a pre-light emitting discharge tube 7; and a flashing energy storing capacitor 6 (hereinafter will be called the pre-light emitting capacitor) which is provided for the discharge tube 7. The capacitor 6 is connected to the booster circuit 3 via the diode 5. Another trigger circuit 8 is arranged to trigger the pre-light emitting discharge tube 7. The discharge tube 7, the capacitor 6 and the trigger circuit 8 constitute a light emitting circuit for distance measurement. A reference symbol IC denotes an integrated circuit which is arranged to form a signal processing circuit for flash photography and is arranged, for example as disclosed in the specification of Japanese Patent Application No. SHO 57-1904 (corresponding to U.S. patent application Ser. No. 444,214). The circuit IC includes a power supply terminal i which is connected to a smoothing capacitor 213 to receive a power supply voltage from the capacitor; a first trigger terminal h which is arranged to actuate the trigger circuit by producing a trigger signal when a first stroke of an operation is performed on a shutter release button of the camera after completion of a charging action on the main capacitor 9; a second trigger terminal g which produces a trigger signal to trigger the trigger circuit 10 when the synchronizing switch of the camera turns on in response to a second stroke of the operation on the release button of the camera after completion of the charging action on the main capacitor 9; a terminal j for receiving the output of an integration circuit which will be described later herein, the terminal j being arranged to receive a voltage corresponding to a distance to an object to be photographed when a pre-light emitting action is performed; a terminal k which produces a signal "0" as charging completion signal upon completion of a charging process on the main capacitor; a terminal a which produces a change-over signal for shifting the photo-taking mode of the camera from a day-light mode to a flash-light mode when the above-stated first stroke of operation on the release button is performed upon completion of the charging action on the main capacitor; a terminal b which is arranged to produce information on an aperture value required for flash photography; a terminal c for receiving information about that the synchronizing switch of the camera has turned on; an earth terminal d; terminals n and m for receiving information on film sensitivity set at a resistor 61; a terminal f connected to bleeder resistors 21 and 22 which are arranged to detect the charging voltage of the main capacitor 9; another terminal e which is connected to the gate of the thyristor 19 and is arranged to turn on the thyristor 19 by producing a flash stop signal therefrom; and a comparator 50 which is arranged within the circuit IC to detect the charging voltage of the main capacitor and to produce the above-stated charging completion signal upon completion of the charging action. The embodiment is provided with a light sensitive element PT which is arranged to receive a reflection light coming from the object to be photographed when a flash light is emitted from the pre-light emitting discharge tube or from the photographing flash discharge tube. The light sensitive element PT is connected to capacitors 57 and **142-1–142-*n*. The above-stated integrated circuit IC is arranged to perform two functions in the following manner: In the first function, when the first stroke of operation is performed, the integrated circuit IC actuates an integration circuit formed by the light sensitive element PT and the capacitor 57. Then, after the lapse of a predetermined period of time, the information on the distance to the object is obtained from the output of this integration circuit. With the distance information received via the terminal j, the circuit IC forms an aperture value signal corresponding to the distance information. This signal is produced from the terminal b. At the same time, one of the capacitors 142-1–142-*n*** is selected according to the aperture value. Then, the light control condition of a light control circuit is thus set at a value in accordance with the above-stated aperture value.

In the second function of the circuit IC, an integration circuit consisting of the light sensitive element and the capacitor selected by the above-stated first function is actuated with the above-stated synchronizing switch turned on. When the output of the integration circuit reaches a predetermined value, a signal is produced from the terminal e to turn on the thyristor 19 to bring a photographic flash light emitting operation to an end. This second function is called the light control function. The first and second functions are carried out by the distance signal detection circuit and the light control circuit. However, since the details of these circuits have been disclosed in the above cited Japanese Patent Application No. SHO 57-1904 and the U.S. patent application Ser. No. 444,214 and also they do not relate directly to the subject matter of the present application, the details of them are omitted from description here.

A Zener diode 212 is parallel connected to the above-stated smoothing capacitor and is arranged to serve as voltage control means for keeping the voltage of power supply to the circuit IC at a constant value and also as switching means when the voltage impressed on the circuit IC comes to exceed a predetermined value. A transistor 34 is connected to the power supply line of the above-stated capacitor 6 and is arranged to serve as charging switch means. The base of the transistor 34 is connected to an intermediate tap of the above-stated booster circuit via resistors 28 and 27 and diodes 30 and 23. A light emitting diode (LED) 53 is connected to the terminal k of the circuit IC and is arranged to indicate completion of a charging process. A diode 39 has its cathode connected to the above-stated terminal k and its anode to the anode of the above-stated diode 30 and a resistor 27. The transistor 34, diodes 30 and 39, the resistor 27 and the commutating diode 23 are interconnected in such a manner that a charging line is formed for the capacitor 6 by turning on the transistor 34 before completion of a charging process on the main capacitor. Upon completion of the charging process, the transistor 34 is turned off to form a control circuit for controlling a charging process on the pre-light emission capacitor by cutting off the charging line of the capacitor 6. A capacitor 24 is arranged to be charged via the diode 23 up to a voltage V2 produced from the above-stated intermediate tap. This capacitor serves as back-up capacitor for the above-stated circuit IC. Another diode 33 has its anode connected to a connection point between the above-stated pre-light emission capacitor 6 and the transistor 34 and its cathode to the base of a transistor 25. The transistor 25 has its collector connected to the capacitor 24 and its emitter to the above-stated capacitor 213 and is thus arranged to serve as switching means for forming a back-up current line for the circuit IC. A resistor 26 is connected between the base and emitter of the above-stated transistor 25. These transistor 25, resistor 26 and diode 33 form a power supply control circuit for controlling supply of the electric charge of the back-up capacitor 24 to the above-stated circuit IC during a charging process on the pre-light emission capacitor 6 after pre-light emission (or pre-flashing). Further, the transistor 25 is arranged to serve also as a detection circuit for detecting a charging current supplied to the capacitor 6.

At the shoe part of the flash device, there are arranged a group of terminals Ta, Tb, Tc and Td to be connected to the corresponding terminals provided at the shoe part of the camera which is not shown.

The embodiment which is arranged as shown in FIG. 1 operates as follows: When the main switch 2 is turned on, the capacitor 213 begins to charge via the diode 211. The charge voltage of the capacitor 213 is then impressed on the circuit IC via the terminal i to render the circuit IC operative.

Meanwhile, the booster circuit 3 also begins to operate to charge the main capacitor 9 via the diode 4 with the boosted output thereof. Before completion of this charging process, the comparator 50 produces a high level signal "1" to cause a current which flows from the booster circuit via the diode 23 and the resistor 27 to flow to the base of the transistor 34 via the transistor 34 as a base current. As a result, the transistor 34 turns on. With the transistor 34 turned on, the capacitor 6 is charged via the transistor 34 with the output of the booster circuit which is produced via the diode 5. Further, since the base of the transistor 25 is connected via the diode 33 to the collector of the transistor 34, the transistor 25 is kept off while the transistor 34 remains on. Therefore, the capacitor 24 is charged with the intermediate tap output of the booster circuit 3.

When the main capacitor 9 is charged up to a predetermined level required for flash photography, the comparator 50 produces a low level signal "0" as a charge completion signal. This signal causes the LED 53 to light up to indicate completion of the charging action. With the output of the comparator 50 having become "0", the current which has been flowing to the base of the transistor 34 is bypassed to the comparator 50. The transistor 34, therefore, turns off. Since the capacity of the capacitor 6 is smaller than that of the main capacitor, charging for the capacitor 6 is completed before completion of charging for the main capacitor. Therefore, only a small current flows to the resistor 26 even when the transistor 34 turns off and the transistor 25 is accordingly kept off.

Let us now assume that the flash device of FIG. 1 is mounted on a camera. When the operating stroke of on the release button of the camera readies its first step or position after completion of a charging process of the flash device, a trigger signal is produced at the terminal h of the circuit IC. This renders the trigger circuit 8 operative to trigger the discharge tube 7. The electric charge of the capacitor 6 is then discharged to the discharge tube 7 to cause the latter to flash. The flash illuminates an object to be photographed. Meanwhile, the above-stated stroke to the first step renders the integration circuit consisting of the light sensitive element PT and the capacitor 57 operative. As a result of that, light which is caused by the above-stated flash and reflected by the object is received by the light sensitive element PT. The capacitor 57 is then charged with a current from the light sensitive element. The value of the current from the light sensitive element corresponds to the intensity of the reflection light. Therefore, the capacitor 57 is charged with the current at a speed corresponding to the distance to the object. Accordingly, the quantity of the electric charge of the capacitor 57 becomes a value corresponding to the distance to the object. The circuit IC then obtains a distance value by detecting the electric charge after the lapse of a predetermined period of time from commencement of the charging process on the capacitor 57. The circuit IC computes an aperture value on the basis of the distance value. Then, one of the capacitors **142-1–142-*n*** is selected according to the aperture value thus computed.

With pre-flash carried out by discharging the electric charge of the capacitor 6, the capacitor 6 is again provided with a charging current via the diode 5. The charging current to be supplied to the capacitor 6 is a relatively large current after completion of pre-flashing. The output of the comparator 50 still remains at the level "0" even after pre-flashing. Accordingly, the transistor 34 remains off. Therefore, the charging current flows to the base of the transistor 25 via the diode 33. This causes the transistor 25 to turn on to form a power supply line for the circuit IC and the electric charge of the capacitor 24 is supplied to the terminal i of the circuit IC. At the time of the charging action on the pre-flashing capacitor, the electric charge of the capacitor 24 thus flows to the power supply terminal i of the circuit IC via the transistor 25. This arrangement ensures uninterrupted supply of an operating voltage to the circuit IC with the back-up current supplied from the capacitor 24 to the circuit IC even when the output of the battery 1 is caused to drop by the charging action on the capacitor 6. In this instance, the charging current of the capacitor 6 which flows via the base of the above-stated transistor 25 is also supplied to the circuit IC as another back-up current.

Further, during the back-up action by the capacitor 24, when the voltage supplied to the terminal i exceeds a predetermined value, the Zener diode 212 becomes conductive to turn on the transistor 34. This causes the transistor 25 to turn off. As a result, the back-up by the electric charge of the capacitor 24 comes to an end. Then, when the voltage of power supply to the circuit IC again drops, the transistor 34 turns off and the transistor 25 turns on to resume the above-stated back-up action. The circuit IC thus has a predetermined potential constnatly impressed thereon to ensure its stable operation. In this embodiment, as has been described above, the charging action on the pre-flashing capacitor ensures the supply of a back-up current from the back-up capacitor to the circuit IC even when the output of the battery drops, so that the operation of the circuit IC can be kept in a stable state.

After this, when the stroke of the release button of the camera reaches its second step or position, the leading curtain of the shutter of the camera which is not shown travels to initiate an exposure. Then, the synchronizing switch turns on in response to the leading curtain of the shutter. The "on" signal of the synchronizing switch comes to the terminal c of the circuit IC via the terminal Tc. The circuit IC then supplies a trigger signal from the terminal g to the trigger circuit 10. The trigger circuit 10 produces a signal to turn on the thyristor 18. The flash discharge tube 13 begins flashing. Meanwhile, the stroke reaching the second step as mentioned above results in operation of the integration circuit consisting of the light sensitive element and a capacitor selected from the capacitors **142-1–142-*n* according to the aperture value. With the integration circuit operated, the circuit IC detects from the output of this integration circuit the quantity of light reflected from the object as a result of flashing of the flash discharge tube. When the output of the integration circuit reaches a predetermined value, that is, when an appropriate quantity of light is emitted by the flash, a flash stop signal is produced at the terminal e of the circuit IC to turn on the thyristor 19. The conductive thyristor 19 discharges the electric charge on the commutation capacitor and turns off another thyristor 18 by applying a reverse bias thereto. With the thyristor 18 thus turned off, the flash discharge tube 13** stops its flash.

A change-over signal is produced at the terminal a of the circuit IC in response to the release button reaching its first position and a signal representing an aperture value determined according to the distance to the object as mentioned in the foregoing. Thus the camera performs an aperture control operation on the basis of the aperture value signal and, at the same time, the shutter time is also controlled according to a shutter time value prescribed for flash photography. However, since these actions to be performed on the camera do not relate directly to the present application, details of these actions are omitted from this description.

With the first stroke operation performed on the release button of the camera, the change-over signal is produced from the terminal a of the circuit IC and the aperture value signal from the terminal b representing an aperture value determined according to the distance to the object as mentioned in the foregoing. Therefore, the camera performs aperture control according to this aperture value signal and shutter control according to the shutter time for flash photography. However, these actions to be performed on the side of the camera do not relate directly to the present invention and thus require no description thereof herein.

In the embodiment shown in FIG. 1, as mentioned above, the charging action on the pre-light emission capacitor is detected and then the electric charge of the back-up capacitor is supplied to the circuit IC. This capacitor charging arrangement ensures that the circuit IC is kept in a stable operating state even when the voltage of the battery comes to drop.

Figure 2:
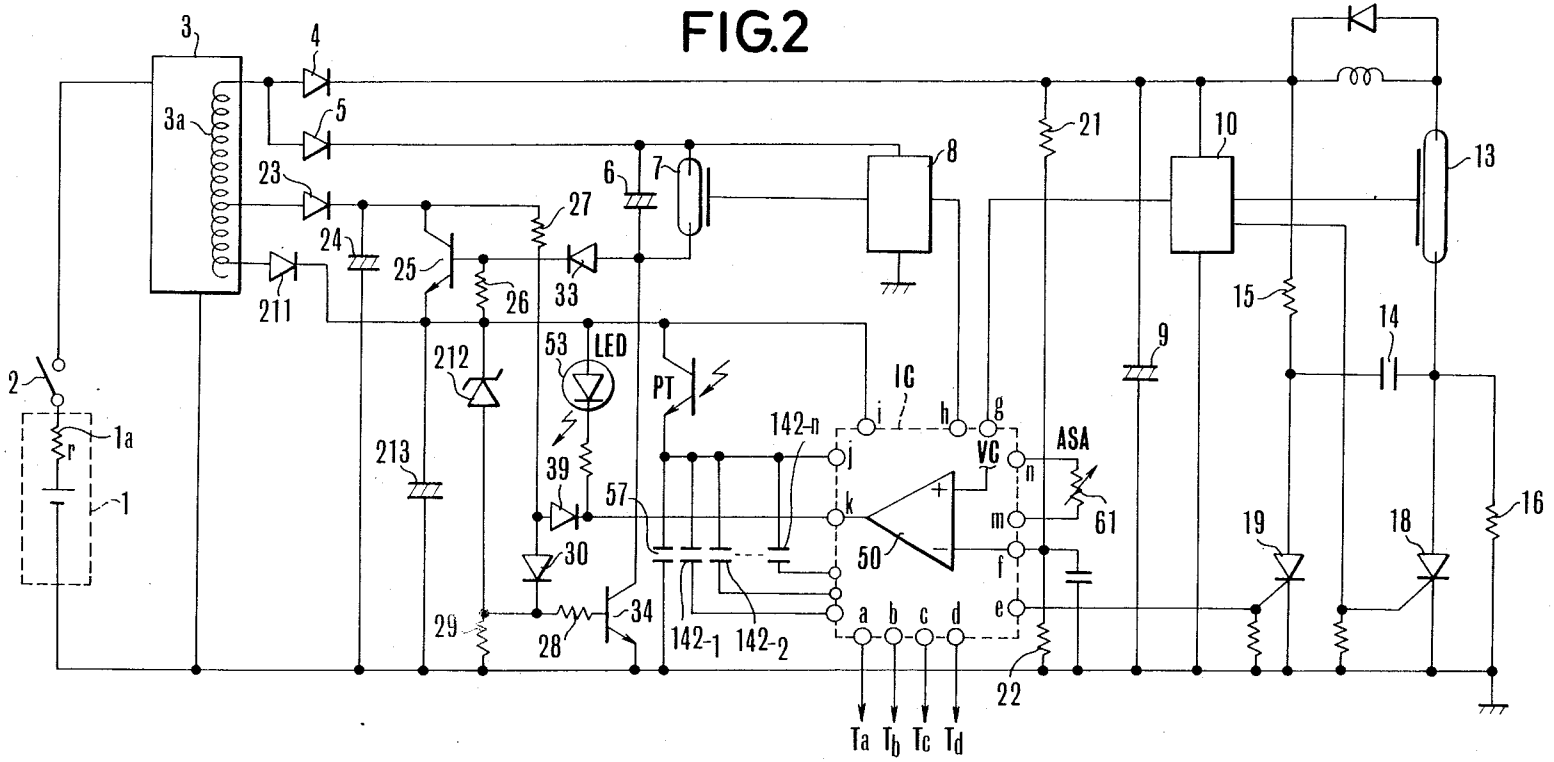
FIG. 2 is a circuit diagram showing another embodiment.

FIG. 2 is a circuit diagram showing a flash device as another embodiment of the present invention. In FIG. 2, the same component elements as those shown in FIG. 1 are indicated by the same reference numerals and symbols. The embodiment differs from the first embodiment shown in FIG. 1 in that the power supply to the circuit IC is arranged to be effected from a booster circuit via a diode 211 instead of being effected directly from the battery 1.

The operation of the embodiment shown in FIG. 2 is similar to that of the embodiment shown in FIG. 1 and, therefore, does not require further description. The output of the booster circuit is used as power source for all the circuits of the embodiment including the circuit IC. Therefore, the battery 1 can be of a low voltage to permit reduction in the number of battery cells required. Further, in the same manner as in the first embodiment shown in FIG. 1, the electric charge of the back-up capacitor 24 is arranged to be supplied to the circuit IC detecting the charging action on the pre-light emission capacitor 6. Therefore, a voltage higher than the operating voltage required for the circuit IC can be supplied to the circuit IC even when the above-stated charging action results in a drop in the output voltage of the booster circuit.

Figure 3:
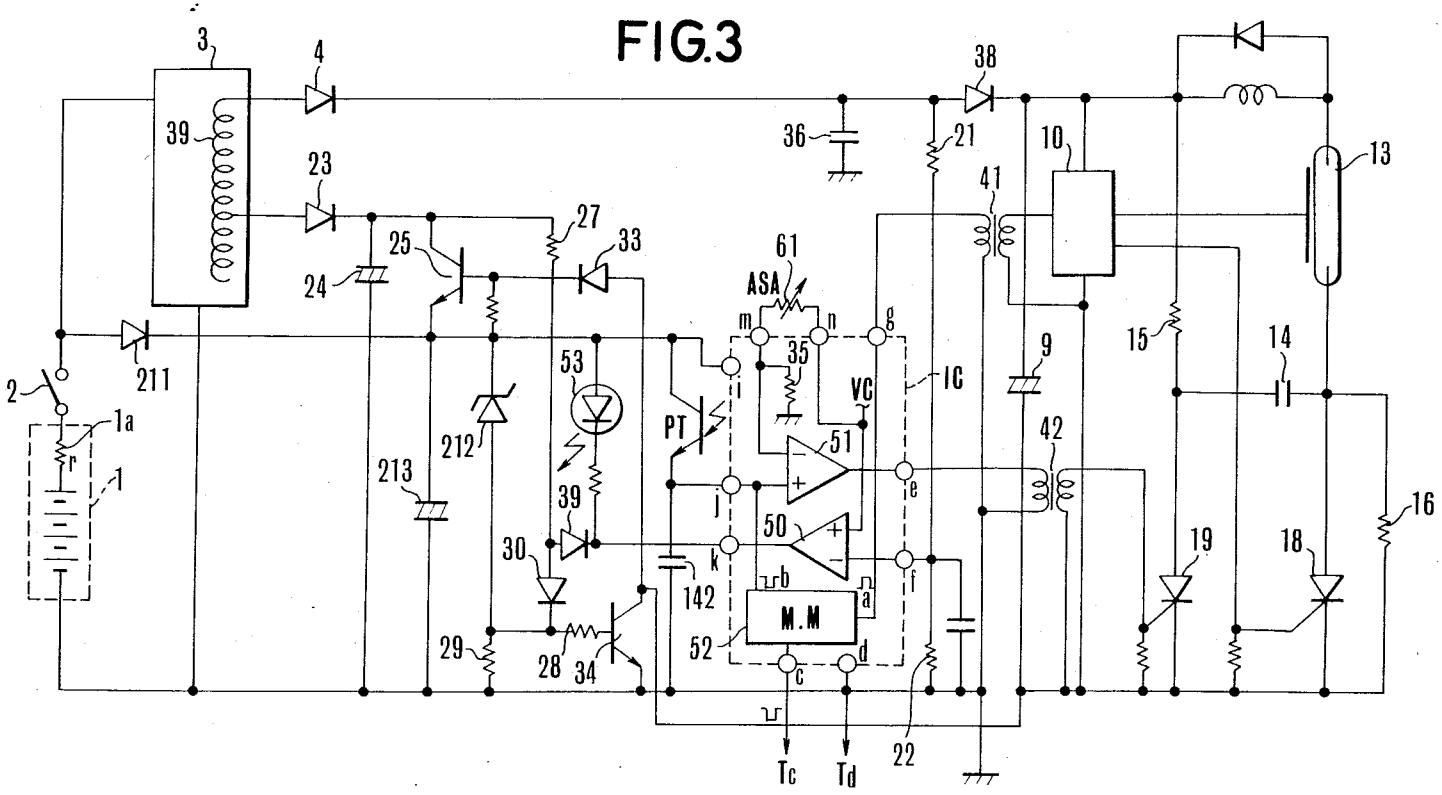
FIG. 3 is a circuit diagram showing a further embodiment of the invention.

FIG. 3 is a circuit diagram showing an embodiment in which the invention is applied to an ordinary computer type electronic flash unit. The circuit diagram includes a capacitor 36 which is arranged to be charged to a value equal to the flash energy storing main capacitor 9; a diode 38 connected between the capacitor 36 and the main capacitor 9; a transformer 41 arranged to produce a voltage for actuating a trigger circuit in response to the pulse produced from the terminal g of the circuit IC; and another transformer 42 arranged to turn on a thyristor 19 in response to a signal produced from the terminal e of the circuit IC.

The circuit IC is an integrated circuit. The circuit IC includes a one-shot circuit MM which is arranged to operate in response to a synchronizing-switch-on signal coming via the terminal c of the circuit IC. A comparator 51 has its (+) input terminal connected to the output of an integration circuit formed by the one-shot circuit MM and a capacitor 142 which is series connected to a light sensitive element PT. Its (−) input terminal is connected to the output terminal of a bleeder which consists of a film sensitivity setting resistor 61 and a resistor 35. A comparator 50 serves for detecting a charging completion state.

The comparator 51, the light sensitive element PT and the capacitor 142 jointly form a light control circuit which causes production of a flash stop signal when the quantity of light received by the light sensitive element reaches a predetermined level. The one-shot circuit MM instantaneously produces a pulse from its output terminal a and is arranged to bring a part between the terminals j and d of the circuit IC into an open state for a predetermined period of time. The rest of the circuit arrangement of the embodiment is identical with that of the embodiment shown in FIG. 1 and thus requires no further description.

The operation of the embodiment shown in FIG. 3 is as follows: When the power source switch 2 is turned on, the booster circuit 3 operates to charge the capacitors 36 and 24. When the capacitor 36 has not been charged up to a predetermined potential, the comparator 50 produces a signal "1". Under that condition, therefore, the transistor 34 is on to allow a charging action to be performed also on the main capacitor 9 in the same manner as in the case of the embodiment shown in FIG. 1. During the process of the above-stated charging action, when the main capacitor 9 is charged up to a sufficiently high potential for flash photography, the output of the capacitor 36 which is equivalent to the main capacitor 9 is detected by the comparator 50.

The comparator 50 then produces a signal "0" as a charging completion signal. With this signal produced from the comparator 50, the transistor 34 turns off to bring the charging action on the main capacitor to an end in the same manner as in the case of the embodiment shown in FIG. 1.

After that, when the release button of the camera is depressed to allow the leading curtain of the shutter to travel, the synchronizing switch turns on and the signal representative of this is transmitted to the one-shot circuit of the circuit IC to cause the one-shot circuit to produce a pulse from its output terminal a. The pulse thus produced is impressed on the transformer 41 to trigger the trigger circuit 10. Therefore, in the same manner as in the case of FIG. 1, the thyristor 18 turns on to cause the electric charge of the main capacitor 9 discharged to the flash tube 13. The flash tube 13 then flashes.

The one-shot circuit brings the part between the terminals j and d of the circuit IC into an open state which lasts for a predetermined length of time while the above-stated pulse is produced from the terminal a in response to the synchronizing-switch-on signal. Accordingly, the capacitor 142 integrates the quantity of reflected light received by the light sensitive element from an object to be photographed as a result of the above-stated flashing action. When the integrated quantity reaches a predetermined level, the comparator 51 produces a signal "1" as a flash stop signal. The signal is transmitted to the transformer 42. The transformer 42 impresses a gate potential on the gate of the thyristor 19. The thyristor turns on. After that, the flash action is brought to a stop with a reverse bias applied to the thyristor 18 by the electric charge of the commutation capacitor in the same manner as in the case of FIG. 1.

After completion of the flash operation, the main capacitor 9 is again charged. During the charging process on the capacitor 9, the charging current is large. The large charging current flows to the base of the transistor 25. This causes the transistor 25 to turn on. Therefore, even when the power source voltage is lowered by the charging action on the main capacitor 9, the electric charge of the back-up capacitor 24 flows to the power supply terminal i of the circuit IC via the transistor to provide the circuit IC with a voltage not lower than the operating voltage required by the circuit IC. The circuit IC is thus always driven into a stable state. Therefore, even where a flip-flop is arranged within the circuit IC to be set in response to the output of the comparator 51 and to cause a light emitting diode to light up for confirmation of light control, the stable driving arrangement for the circuit IC after a flash operation enables the light control confirming display to be correctly accomplished.

In the specific embodiment described above, the completion of a flash is arranged to be detected through a charging action on the flash energy storing capacitor. However, this flash detecting arrangement may be replaced with the following arrangement: A light sensitive element is arranged to receive the light emitted from the flash tube while a one-shot circuit is arranged to be operated by the output of this light sensitive element; and with a flash action detected by the light sensitive element, the transistor 25 is turned on by the output of that one-shot circuit to form a power supply line.

Further, in this embodiment, the charging detection to be made during flashing is accomplished by detecting the charging current for the flash energy storing capacitor. Instead of this arrangement, however, the detection of course may be accomplished by detecting the charge level of the capacitor by means of a bleeder resistor or the like and then by keeping the above-stated transistor 25 on until the level reaches a predetermined value.

Further, the embodiment uses the transistor 25 as a switching means both for forming a detecting circuit and for forming a power supply line. However, instead of such arrangement, a transistor to be used as switching means may be discretely arranged from another transistor to be used as the detecting circuit. In that case, the transistor to be used as the detecting circuit may be allowed to perform a switching action after flashing and the other transistor to be used for forming the power supply line may be arranged to be turned on by the switching action.

In accordance with this invention, as has been described in the foregoing, a flash is arranged to be detected; and the electric charge of the back-up capacitor is supplied when flashing is performed to the processing circuit which is an integrated circuit. Therefore, the integrated circuit can be kept in a stable operative state even when the power source voltage drops after flashing. This is a great advantage.

What I claim:

1. A flash device comprising:

(a) a power supply circuit;

(b) a booster circuit for boosting the voltage of said power supply circuit;

(c) a flash energy storing capacitor arranged to be charged with the output of said booster circuit;

(d) flash tube means for emitting a flash of light by discharging the charge stored at said flash energy storing capacitor;

(e) an integrated circuit arranged to be rendered operative by power from said power supply circuit;

(f) a back-up capacitor arranged to store an electric charge to be used for a back-up purpose; and (g) switching means between said back-up capacitor and said integrated circuit for transmitting the electric charge of said back-up capacitor to said integrated circuit when a charging action of said flash energy storing capacitor or a light emitting action by said flash means is being performed.

2. A flash device comprising:

(a) a power supply circuit;

(b) a booster circuit for boosting the voltage of said power supply circuit;

(c) a flash energy storing capacitor arranged to be charged with the output of said booster circuit;

(d) flash means emitting a flash of light by discharging the charge stored at said flash energy storing capacitor;

(e) an integrated circuit for receiving power from said booster circuit;

(f) a back-up capacitor arranged to store an electric charge to used for a back-up purpose; and (g) a switching circuit between said back-up capacitor and said integrated circuit for transmitting the electric charge of said back-up capacitor to said integrated circuit when the charging action to said flash energy storing capacitor or a light emitting action by said flash means is being performed.

3. A flash device comprising:

(a) a power source;

(b) a booster circuit for boosting the voltage of said power source;

(c) a flash energy storing capacitor arranged to be charged with the output of said booster circuit;

(d) a flash tube arranged to have the charge voltage of said storing capacitor impressed thereon;

(e) an integrated circuit arranged to be rendered operative by power from said power source;

(f) a back-up capacitor arranged to store an electric charge to be used for a back-up purpose;

(g) power supply lines for said back-up capacitor and said integrated circuit; and (h) a switching circuit on said power supply lines and arranged to transmit the electric charge of said back-up capacitor to said integrated circuit upon detection of a charging action on said storing capacitor.

4. A flash device comprising:

(a) a power source;

(b) a booster circuit for boosting the voltage of said power source;

(c) a flash energy storing capacitor arranged to be charged with the output of said booster circuit;

(d) a flash tube arranged to have the charge voltage of said storing capacitor impressed thereon;

(e) an integrated circuit arranged to receive power from said booster circuit;

(f) a back-up capacitor arranged to store an electric charge to be used for a back-up purpose;

(g) power supply lines for said back-up capacitor and said integrated circuit; and (h) a switching circuit on said power supply lines and arranged to transmit the electric charge of said back-up capacitor to said integrated circuit upon detection of a charging action on said storing capacitor.

5. A flash device comprising:

(a) a power source;

(b) a booster circuit for boosting the voltage of said power source;

(c) a flash energy storing capacitor arranged to be charged with the output of said booster circuit;

(d) a flash tube arranged to have the charge voltage of said storing capacitor impressed thereon;

(e) an integrated circuit arranged to be rendered operative by power from said power sources;

(f) a back-up capacitor arranged to store an electric charge to be used for a back-up purpose;

(g) a detecting circuit for detecting the flash action of the flash tube; and (h) a switching circuit between said back-up capacitor and said integrated circuit and arranged to transmit the electric charge of said back-up capacitor to said integrated circuit in response to the output of said detecting circuit.

6. A flash device comprising:

(a) a power source;

(b) a booster circuit for boosting the voltage of said power source;

(c) a flash energy storing capacitor arranged to be charged with the output of said booster circuit;

(d) a flash tube arranged to have the charge voltage of said storing capacitor impressed thereon;

(e) an integrated circuit arranged to receive power from said booster circuit;

(f) a back-up capacitor arranged to store an electric charge to be used for a back-up purpose;

(g) a detecting circuit for detecting the flash action of the flash tube; and (h) a switching circuit between said back-up capacitor and said integrated circuit and arranged to transmit the electric charge of said back-up capacitor to said integrated circuit in response to the output of said detecting circuit.

7. A flash device having a flash means and a capacitor for supplying a charge to said flash means, comprising:

(a) a power supply circuit;

(b) an integrated circuit for receiving a supply of operating power from said power supply circuit;

(c) a back-up capacitor arranged to store an electric charge to be used for a back-up purpose; and (d) a switching means connected between said integrated circuit and the back-up capacitor and arranged to transmit the electric charge of said back-up capacitor to said integrated circuit when said switching circuit turns ON.

8. A flash device comprising:

(a) a power supply circuit;

(b) a booster circuit for boosting the voltage of said power supply circuit;

(c) a flash energy storing capacitor arranged to be charged with the output of said booster circuit;

(d) flash tube means for emitting a flash of light by discharging the charge stored at said flash energy storing capacitor;

(e) an integrated circuit for operating in response to power from said power supply circuit;

(f) a back-up capacitor to store an electric charge for back-up purposes; and (g) a switching circuit connected between said back-up capacitor and said integrated circuit and having an input portion connected to said flash energy storing capacitor, said switching circuit being responsive to the charging current after the electric charge stored at said flash energy storing capacitor is discharge to said flash tube means and when said storing capactor is charged by the booster circuit for turning on and transmitting the charge of the back-up capacitor to said integrated circdit.

* * * * *